United States Patent [19]

Geffcken et al.

[11] Patent Number: 4,628,228

[45] Date of Patent: Dec. 9, 1986

[54] GAS DISCHARGE DISPLAY DEVICE

[75] Inventors: Walter Geffcken, Munich; Burkhard Littwin, Hohenschäftlarn; Rolf Wengert, Munich, all of Fed. Rep. of Germany

[73] Assignee: Siemens Aktiengesellschaft, Berlin and Munich, Fed. Rep. of Germany

[21] Appl. No.: 716,526

[22] Filed: Mar. 27, 1985

Related U.S. Application Data

[63] Continuation of Ser. No. 470,702, Feb. 28, 1983, abandoned.

[30] Foreign Application Priority Data

Mar. 3, 1982 [DE] Fed. Rep. of Germany ..... 3207685

[51] Int. Cl.[4] ..... G09G 3/10; H01J 17/49

[52] U.S. Cl. ..... 315/169.4; 313/584; 313/585; 313/596; 313/597

[58] Field of Search ..... 315/169.4; 313/584, 313/585, 596, 597, 599

[56] References Cited

U.S. PATENT DOCUMENTS

| | | | |
|---|---|---|---|
| 3,863,087 | 1/1975 | Holz | 315/169.4 X |
| 3,886,389 | 5/1975 | Ogle | 313/585 |
| 3,956,667 | 5/1976 | Veith | 315/169.4 |
| 4,185,229 | 1/1980 | Yoshikawa et al. | 315/169.4 |
| 4,322,659 | 3/1982 | De Jule et al. | 315/169.4 X |
| 4,328,444 | 5/1982 | Littwin | 315/169.4 X |

FOREIGN PATENT DOCUMENTS

| | | |
|---|---|---|
| 2412869 | 10/1975 | Fed. Rep. of Germany . |
| 2750587 | 5/1979 | Fed. Rep. of Germany . |
| 2952601 | 7/1981 | Fed. Rep. of Germany . |

*Primary Examiner*—David K. Moore
*Assistant Examiner*—Vincent DeLuca
*Attorney, Agent, or Firm*—Herbert L. Lerner; Laurence A. Greenberg

[57] ABSTRACT

Gas discharge display device having a gas-filled space gas-tightly closed on one side by a front plate and on a side opposite thereto by a back plate and subdivided by a control plate into a gas discharge space and a post-acceleration space, the control plate carrying electrode runs respectively addressable separately and forming a matrix as row conductors on one side of the control plate and as column conductors on the other side of the control plate, and having, together with the electrode runs, control through holes at intersection points of the matrix, a fluorescent screen disposed on the side of the front plate opposite the control plate and defining the post-acceleration space, the fluorescent screen having an anode layer thereon, and at least one insulated cathode on the side of the back plate and defining the gas discharge space, the control plate having, on the side thereof facing towards the post-acceleration space, a plate having a raster of holes formed therein coincident with a raster of the control holes formed in the control plate, including a supplementary control plate having selectively one and two additional potential planes separated from one another, the planes having on at least one side thereof strip lines for conducting an electric current, the strip lines being aligned parallel to the row conductors of the control plate and having selectively applicable thereto an electric passing and blocking potential for electrons flying towards the fluorescent screen.

11 Claims, 6 Drawing Figures

GAS DISCHARGE DISPLAY DEVICE

This is a continuation of Ser. No. 470,702, filed Feb. 28, 1983, now abandoned.

The invention relates to a gas discharge display device having a gas-filled space gas-tightly closed on one side by a front plate and on a side opposite thereto by a back plate and subdivided by a control plate into a gas discharge space and a post-acceleration space, the control plate carrying electrode runs respectively addressable separately and forming a matrix as row conductors on one side of the control plate and as column conductors on the other side of the control plate and having, together with the electrode runs, control through-holes at intersection points of the matrix, a fluorescent screen disposed on the side of the front plate opposite the control plate and defining the post-acceleration space, the fluorescent screen having an anode layer thereon, and at least one insulated cathode on the side of the back plate and defining the gas discharge space, the control plate having, on the side thereof facing towards the post-acceleration space, a plate having a raster of holes formed therein coincident with a raster of the control holes formed in the control plate.

A gas discharge display device (plasma panel) constructed in this manner, which is provided with a planar cathode, is known from German Published Non-Prosecuted Application (DE-OS) No. 24 12 869. It is known from German Published Non-Prosecuted Application (DE-OS) No. 27 50 587, to achieve a stable control plate construction by filling the post-acceleration space between the fluorescent screen and the control plate with a stack of thin glass foils which are provided with holes by an etching process.

From German Published Non-Prosecuted Application (DE-OS) No. 29 52 601, a gas discharge display device with a support for the control plate provided on the side of the post-acceleration space may also be assumed as known. In this flat plasma viewing screen, the tetrode grid is metallized over the entire surface thereof.

The crosstalk effect in the column directon leads to a reduction in contrast on the flat plasma viewing screen in the vicinity of a line which is switched-on brightly.

It is therefore an object of the invention to provide a gas discharge display device which prevents this crosstalk effect and, thereby, prevents a reduction in contrast on the fluorescent screen.

With the foregoing and other objects in view, there is provided, in accordance with the invention, a gas discharge display device having a gas-filled space gas-tightly closed on one side by a front plate and on a side opposite thereto by a back plate and subdivided by a control plate into a gas discharge space and a post-acceleration space, the control plate carrying electrode runs respectively addressable separately and forming a matrix as row conductors on one side of the control plate and as column conductors on the other side of the control plate and having, together with the electrode runs, control through-holes at intersection points of the matrix, a fluorescent screen disposed on the side of the front plate opposite the control plate and defining the post-acceleration space, the fluorescent screen having an anode layer thereon, and at least one insulated cathode on the side of the back plate and defining the gas discharge space, the control plate having, on the side thereof facing towards the post-acceleration space, a plate having a raster of holes formed therein, coincident with a raster of the control holes formed in the control plate, including a supplementary control plate having selectively one and two additional potential planes separated from one another, said planes having on at least one side thereof strip lines for conducting an electric current, the strip lines being aligned parallel to the row conductors of the control plate and having selectively applicable thereto an electric passing and blocking potential for electrons flying towards the fluorescent screen.

In accordance with another feature of the invention, the supplementary control plate has the strip lines on the side thereof facing away from the fluorescent screen and a conducting layer on the entire surface of the side thereof facing towards the fluorescent screen.

In accordance with a further feature of the invention a respective strip line borders through-openings formed in the supplementary control plate, the through-openings in the supplementary control plate forming with the through-holes of a row conductor of the control plate a row of common passageway openings for electrons from the gas discharge space into the post-acceleration space.

In accordance with an added feature of the invention, a respective strip line of the supplementary control plate has an electric passing potential applied thereto and borders, together with a respective switch-on row conductor of the control plate, on a row of common passageway openings for electrons, the remaining strip lines having an electric blocking potential applied thereto.

In accordance with an additional feature of the invention there is provided a weakly conductive layer disposed in an area between the individual strip lines of the supplementary control plate so as to prevent electric charging.

To reduce the amount of addressing circuitry, in accordance with yet another feature of the invention, the strip lines of the supplementary control plate can be combined into conductor groups. Respective strip lines following a sequence of several strip lines are periodically connected to one another electrically. The number of the strip lines per conductor group may be between two and the total number of strip lines on the supplementary control plate. An advantageous number is two, and, in accordance with yet a further feature of the invention, all of the strip lines of the supplementary control plate at odd-numbered locations of the sequence of strip lines and all of the so-called even-numbered strip lines are electrically connected to each other, respectively two interleaved conductor combs being produced thereby.

Thus, the lines adjacent to a line which has just been switched-on brightly may be switched to dark effectively at relatively low cost. In accordance with yet an additional feature of the invention, the conductor comb belonging to the line that has been switched-on to bright is connected to passing potential, while the other conductor comb is electrically blocked. The potentials change when stepping to the next line.

For construction of the gas discharge display device according to the invention with several parallel strip cathodes, an advantageous number of strip lines within a group is equal to the number of the line conductors which cover or coincide with the width of a cathode step.

That strip line, respectively, of the supplementary control plate which is located within a group disposed opposite the anode line conductor switched to "passing" receives a "passing" potential, while the remaining ones are subjected to a blocking potential, in accordance with a concomitant feature of the invention.

Other features which are considered as characteristic for the invention are set forth in the appended claims.

Although the invention is illustrated and described herein as embodied in a gas discharge display device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
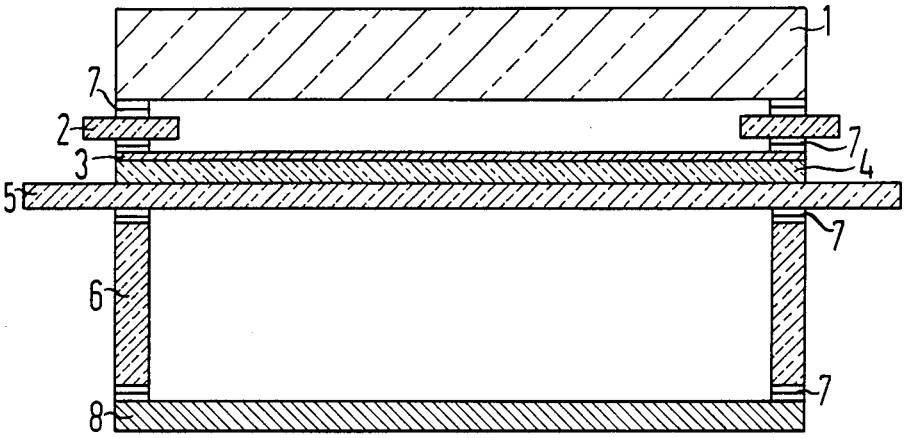
FIG. 1 is a cross-sectional view of a conventional gas discharge display device.

As to the figures of the drawing, parts which do not contribute indispensably to an understanding of the invention have not been identified therein or have been omitted therefrom.

Referring now more specifically to the drawing and first, particularly, to FIG. 1 thereof, there is shown a conventional or prior-art gas discharge display device formed essentially of a cathode 8 and a control plate 5 which define or bound a gas discharge space (plasma space), as well as of a luminescent or fluorescent screen (viewing screen) 1 which, together with the control plate 5, defines a post-acceleration space. The control plate 5 is supported on the side thereof facing towards the post-acceleration space by a support plate (tetrode grid) 4 which has a non-illustrated raster or array of holes formed therein coinciding with a non-illustrated raster of control holes. The support plate (tetrode grid) 4 is provided with a metallization (tetrode grid metallization) 3 on the side thereof facing towards the luminescent or fluorescent screen 1, and a space (post acceleration space) free of supports is formed between the fluorescent or luminescent screen 1 and the metallized support plate 4. A spacing frame 2 surrounds the post-acceleration space, and a frame 6 the gas discharge space (plasma space). Suitable bonding means, such as glass solder, for example, is provided for gas-tightly bonding the spacing frame 2 to the fluorescent or luminescent screen 1 and the support plate 4, as well as the frame 6 to the control plate 5 and the cathode 8. The respective bonding seams 7 are diagrammatically shown.

Figure 2:
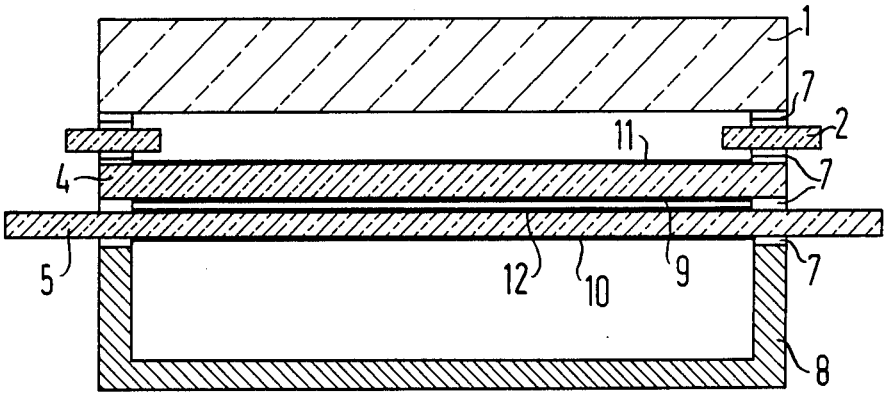
FIG. 2 is a diagrammatic cross-sectional view of a gas discharge display device according to the invention, with a strip-shaped tetrode grid and anode metallization over the entire surface thereof.

The gas discharge display device according to the invention shown in FIG. 2 is formed essentially of a cathode 8 and a control plate 5, which is provided on one side thereof with line or row conductors 10, and on the other side thereof with column conductors 12. The control plate 5 and the cathode 8 are connected or bonded at the edge by a glass solder layer 7 and enclose the gas discharge space (plasma space). Between the control plate 5 and the fluorescent or luminescent screen (viewing screen) 1, a supplementary control plate 4 is disposed which is provided with a metallization layer 11 on the side thereof facing towards the luminescent or fluorescent screen 1, and with strip conductors 9 on the side thereof facing away from the screen 1. A spacing frame 2 is provided between the supplementary control plate 4 and the fluorescent or luminescent screen 1. The fluorescent or luminescent screen 1, the spacing frame 2, the supplementary control plate 4 and the control plate 5 are in turn connected or bonded at the edge of the gas discharge display device by glass solder layers 7.

Figure 3:
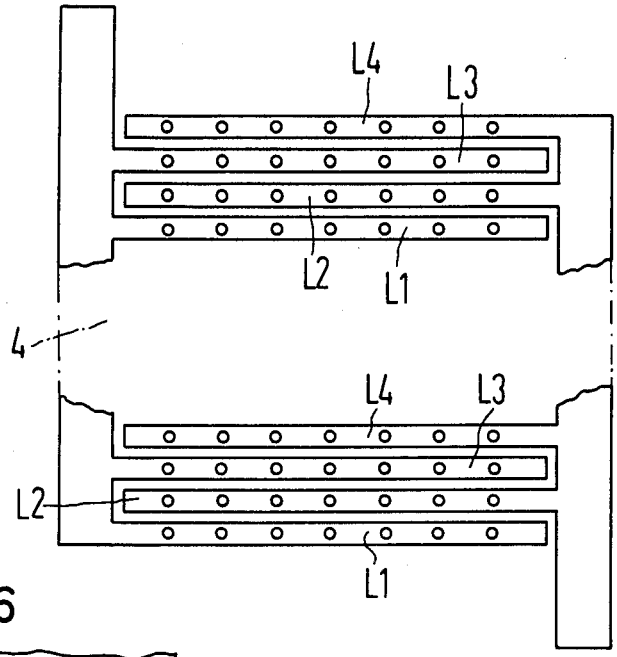
FIG. 3 is a diagrammatic top plan view of two comb conductors disposed on the tetrode grid of the gas discharge display device of FIG. 2.

In FIG. 3, there is shown purely diagrammatically an arrangement of two comb conductors $L_1$, $L_3$, on the one hand, and $L_2$, $L_4$, on the other hand. The comb conductors with conductors L identified by even-number subscripts and odd-number subscripts, respectively, have blocking and passing potentials, respectively, applied thereto in order to block effectively both adjacent lines or conductors of a control-plate row line or conductor which has in fact been brightly switched on.

Figure 4:
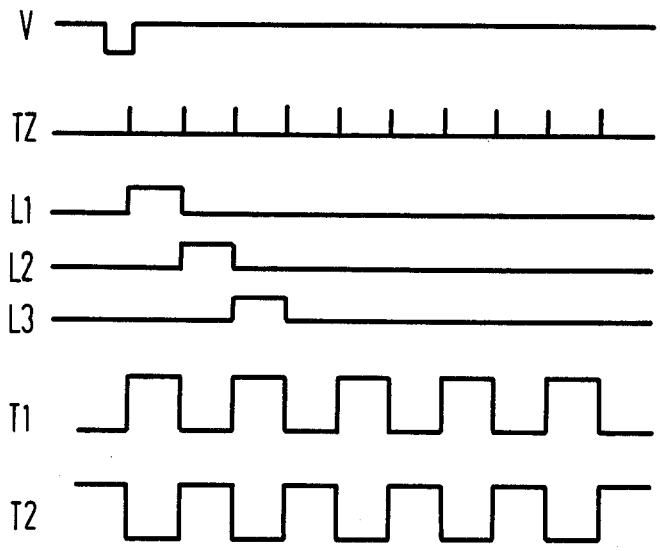
FIG. 4 is a plot diagram showing the waveform of control potentials.

In FIG. 4, the waveform of the control potentials at the even-numbered and the odd-numbered comb conductor is shown in relation to the row-conductor control or driving pulses of the control plate. The image or picture-synchronizing pulse is shown at V, and the line advance at TZ. The first, second and third line or row conductors are shown, respectively, at L1, L2 and L3. Pulse distribution on the odd-numbered comb conductor is illustrated at T1, while the pulse sequence on the even-numbered comb conductor is represented at T2.

Figure 5:
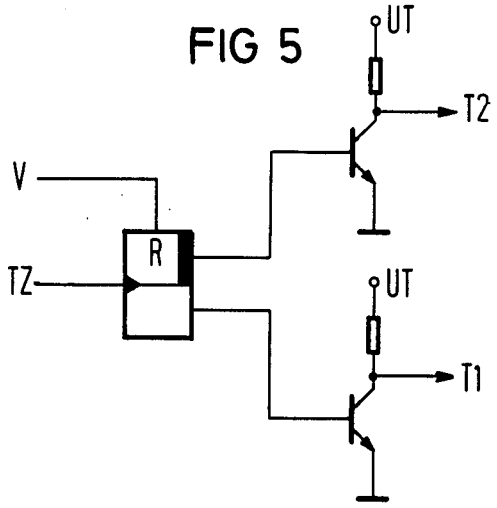
FIG. 5 is a diagram of the addressing circuit for the comb conductors of the tetrode grid shown in FIG. 3.

FIG. 5 shows the drive circuit for the comb conductors of the tetrode grid.

Figure 6:
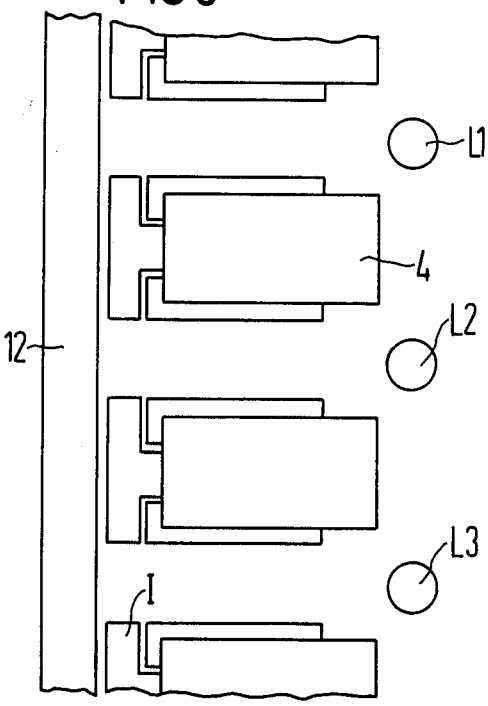
FIG. 6 is a diagrammatic view of another embodiment of the comb conductors on the tetrode grid of a gas discharge display device according to the invention.

In FIG. 6, there is illustrated a control plate construction suitable for driving the gas discharge display device (flat plasma viewing screen) according to the invention, wherein the metallization of the supplementary control plate (tetrode grid) 4 preferably formed of photo-forming glass, especially the comb electrode for suppressing column crosstalk, is integrated into the support plate for the row and column lines or conductors. The photo-forming glass plate 4 serves as a support for the row lines $L_1$, $L_2$ and $L_3$ and the column lines 12. The comb electrode metallization K is located together with an insulating layer I on the photo-forming glass plate 4 behind the column lines 12, so that the post-accelerating voltage, in contrast with the heretofore conventional construction, does not lead to or cause point discharges at the edges of the lines.

The foregoing is a description corresponding to German Application No. P 32 07 685.1, dated Mar. 3, 1982, the International priority of which is being claimed for the instant application, and which is hereby made part of this application. Any discrepancies between the foregoing specification and the aforementioned corresponding German application are to be resolved in favor of the latter.

We claim:

1. Gas discharge display device having a gas-filled space gas-tightly closed on one side by a front plate and on a side opposite thereto by a back plate and subdivided by a control plate into a gas discharge space and a post-acceleration space, the control plate having electrode paths disposed thereon respectively addressable separately and forming a matrix as row conductors on one side of the control plate and as column conductors on the other side of the control plate, and having, together with the electrode paths, control through-holes at intersection points of the matrix, a fluorescent screen disposed on the side of the front plate oppoite the control plate and defining the post-acceleration space, the fluorescent screen having an anode layer thereon, and at least one insulated cathode on a side of the back plate and defining the gas discharge space, the control plate having, on the side thereof facing towards the post-acceleration space, a plate having a raster of holes formed therein coincident with a raster of the control holes formed in the control plate, comprising a supplementary control plate having a selective number of at most two additional potential planes separated from one another, and strip lines disposed on at least one side of said supplementary control plate for conducting an electric current, said strip lines being aligned parallel to the row conductors of the control plate and having selectively applicable thereto an electric passing and blocking potential for electrons flying towards the fluorescent screen.

2. Device according to claim 1 wherein said supplementary control plate has said strip lines on the side thereof facing away from the fluorescent screen, and a conducting layer on the entire surface of the side thereof facing towards the fluorescent screen.

3. Device according to claim 1 wherein a respective strip line borders through-openings formed in said supplementary control plate, said through-openings in said supplementary control plate forming with said through-holes of a row conductor of said control plate a row of common passageway openings for electrons from the gas discharge space into the post-acceleration space.

4. Device according to claim 1 wherein a respective strip line of said supplementary control plate has an electric passing potential applied thereto and borders, together with a respective switched-on row conductor of said control plate, on a row of common passageway openings for electrons, the remaining strip lines having an electric blocking potential applied thereto.

5. Device according to claim 1 wherein respective strip lines of said supplementary control plate following one another periodically at a spacing of a plurality of said strip lines are electrically conductively connected to one another so as to form conductor groups.

6. Device according to claim 5 wherein said strip lines of said supplementary control plate are disposed in sequence, the strip lines at odd-numbered locations of said sequence being electrically conductively connected to one another, and the strip lines at the even-numbered locations being likewise electrically conductively connected to one another.

7. Device according to claim 6 wherein said strip lines of said supplementary control plate are also disposed in sequence with the strip lines at odd-numbered locations of the sequence mutually connected electrically conductively, and the strip lines at the even-numbered locations likewise mutually connected electrically conductively, said odd-numbered and said even-numbered strip lines, respectively, of said supplementary control plate being effective by electric passing and blocking potentials, respectively, applied thereto for controlling the electrons passed through by the even-numbered and odd-numbered row conductors, respectively, of said control plate.

8. Device according to claim 7 wherein the even-numbered strip lines of said supplementary control plate are connected to an electric passing potential and the odd-numbered strip lines to an electric blocking potential when an even-numbered row conductor of said control plate is switched on brightly and vice versa.

9. Device according to claim 1 including a weakly conductive layer disposed in an area between the individual strip lines of said supplementary control plate so as to prevent electric charging.

10. Device according to claim 5 wherein the number of strip lines in a conductor group corresponds to the width of the at least one cathode.

11. Device according to claim 7 wherein a respective strip line of a conductor group located above a respective row switched to passing has an electric passing potential applied thereto, the remaining strip lines of said conductor group having an electric blocking potential applied thereto.

* * * * *